United States Patent [19]

Santroch

[11] 3,977,093

[45] Aug. 31, 1976

[54] COLD WEATHER SHOE

[75] Inventor: Gilbert L. Santroch, Hayward, Calif.

[73] Assignee: The Raymond Lee Organization, Inc., New York, N.Y. ; a part interest

[22] Filed: Jan. 19, 1976

[21] Appl. No.: 650,136

[52] U.S. Cl. ..... 36/2.6
[51] Int. Cl.[2] ..... A43B 7/02
[58] Field of Search ..... 36/2.6, 137

[56] References Cited

UNITED STATES PATENTS

| | | | |
|---|---|---|---|
| 382,681 | 5/1888 | Battor | 36/2.6 |
| 1,430,404 | 9/1922 | Radford | 36/2.6 |
| 3,008,038 | 11/1961 | Dickens et al. | 36/137 |

*Primary Examiner*—Patrick D. Lawson
*Attorney, Agent, or Firm*—Daniel Jay Tick

[57] ABSTRACT

A hollow heel is movably mounted in the heel area of the bottom of a shoe. A battery is mounted in the heel. Electric heating elements are mounted at the bottom of the shoe in the area of the sole thereof. A switch at the bottom of the shoe in the heel area thereof is operable by the heel of the foot of a wearer. A circuit at the bottom of the shoe electrically connects the battery, the heating elements and the switch in circuit whereby the heating elements are selectively energized by the battery via the switch.

4 Claims, 7 Drawing Figures

COLD WEATHER SHOE

BACKGROUND OF THE INVENTION

The present invention relates to a cold weather shoe. More particularly, the invention relates to a cold weather shoe having an enclosure having a bottom with an inside surface and an outside surface, a sole on the outside surface of the bottom and a heel area on the outside surface of the bottom.

Objects of the invention are to provide a cold weather shoe of simple structure, which is inexpensive in manufacture and functions efficiently, effectively and reliably to keep a person's feet warm in cold weather.

BRIEF DESCRIPTION OF THE DRAWINGS

In order that the invention may be readily carried into effect, it will now be described with reference to the accompanying drawing, wherein.

DETAILED DESCRIPTION OF THE INVENTION

Figure 1:
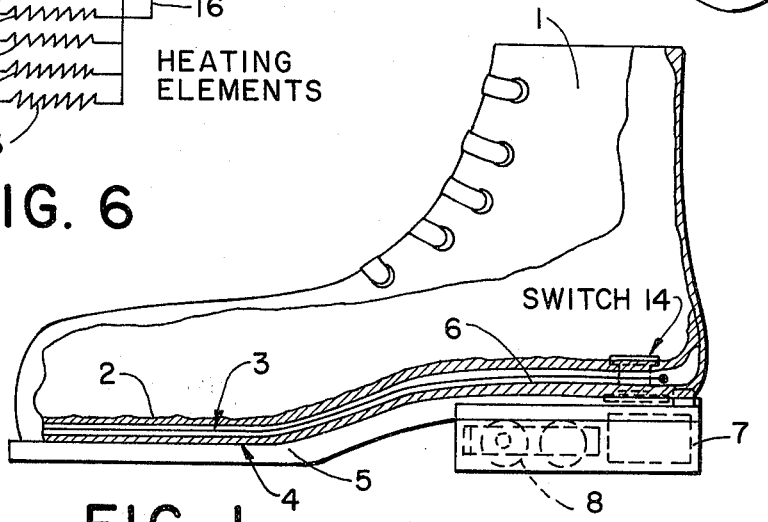
FIG. 1 is a side view of an embodiment of the cold weather shoe of the invention.

The cold weather shoe of the invention has an enclosure 1 having a bottom 2 with an inside surface 3 and an outside surface 4 (FIG. 1). A sole 5 is provided on the outside surface 4 of the bottom 2 and a heel area 6 is provided on the outside surface of said bottom, as shown in FIG. 1.

In accordance with the invention, a hollow heel 7 (FIGS. 1 and 5) is movably mounted in the heel area 6 of the bottom of the shoe.

Figure 6:
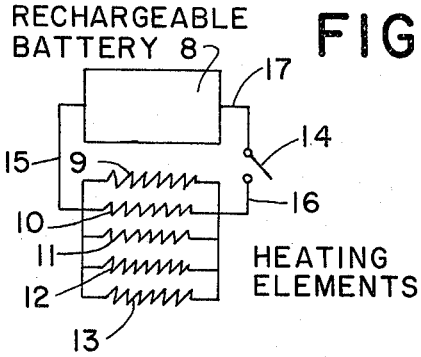
FIG. 6 is a circuit diagram of the cold weather shoe of the invention.

A rechargeable battery 8 of any suitable known type (FIGS. 1, 5 and 6) is mounted in the heel 7 of the shoe.

Figure 2:
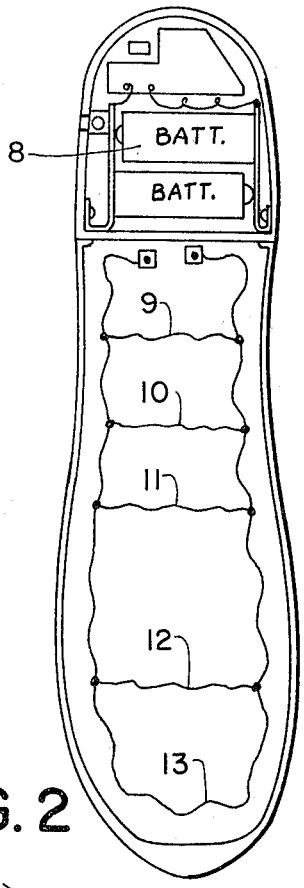
FIG. 2 is a view of the bottom of the embodiment of FIG. 1.
Figure 3:
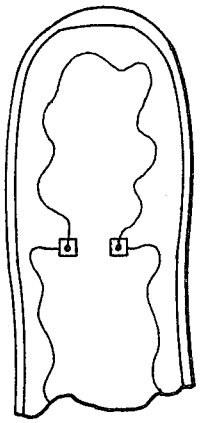
FIG. 3 is a view of part of the bottom of the embodiment of FIG. 1.

Electric heating elements 9, 10, 11, 12, 13 (FIGS. 2 and 6) of any suitable known type are mounted at the bottom 2 of the shoe in the area of the sole 5 thereof.

A switch 14 (FIGS. 1 and 6) is provided at the bottom of the shoe in the heel area 6 thereof and is operable by the heel of the foot of a wearer. The switch 14 may comprise any suitable push-button switch of known type which is switched ON when it is depressed and remains ON until it is permitted to rise and is then depressed again to switch it OFF. The switch remains OFF, until it is permitted to rise and is then depressed to switch it ON.

A circuit 15, 16, 17 (FIG. 6) at the bottom of the shoe, positioned between the outside surface 4 of the bottom of the shoe and the sole 5 thereof, electrically connects the battery 8, the heating elements 9 to 13 and the switch 14 in circuit whereby the heating elements are selectively energized by the battery via said switch.

Figure 5:
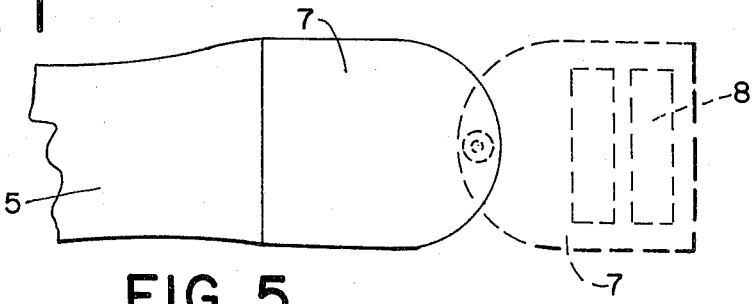
FIG. 5 is a bottom view of part of the embodiment of FIG. 1.

The heel 7 is preferably pivotally mounted on the shoe, as shown in FIG. 5.

Figure 4:
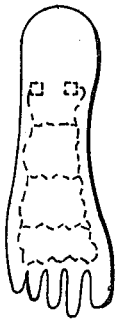
FIG. 4 is a view of the bottom of another embodiment of the cold weather shoe of the invention.

In the embodiment of FIG. 4, the toe end of the bottom 2 of the shoe is shaped in the configuration of the individual toes of the wearer.

Figure 7:
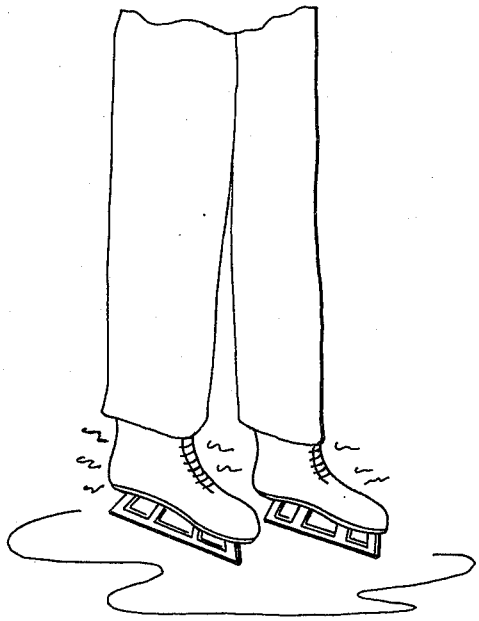
FIG. 7 is a perspective view of a pair of another embodiment of the cold weather shoe of the invention.

In the embodiment of FIG. 7, the cold weather shoe is an ice skate.

While the invention has been described by means of specific examples and in specific embodiments, I do not wish to be limited thereto, for obvious modifications will occur to those skilled in the art without departing from the spirit and scope of the invention.

I claim:

1. A cold weather shoe having an enclosure having a bottom with an inside surface and an outside surface, a sole on the outside surface of the bottom and a heel area on the outside surface of the bottom, said cold weather shoe comprising a hollow heel movably mounted in the heel area of the bottom of the shoe;

battery means mounted in the heel;

electric heating elements mounted at the bottom of the shoe in the area of the sole thereof;

switch means at the bottom of the shoe in the heel area thereof and operable by the heel of the foot of a wearer; and circuit means at the bottom of the shoe electrically connecting the battery means, the heating elements and the switch means in circuit whereby the heating elements are selectively energized by the battery means via said switch means.

2. A cold weather shoe as claimed in claim 1, wherein the battery means comprises a rechargeable battery.

3. A cold weather shoe as claimed in claim 1, wherein the circuit means is positioned between the outside surface of the bottom of the shoe and the sole thereof.

4. A cold weather shoe as claimed in claim 1, wherein the heel is pivotally mounted on the shoe.

* * * * *